United States Patent [19]

Schmid

[11] 4,024,992

[45] May 24, 1977

[54] AIR ATOMIZER BOTTLE SPRAYER WITH SCREW CAP

[76] Inventor: Hans G. Schmid, 26 Locust Lane, Huntington, N.Y. 11743

[22] Filed: Nov. 24, 1975

[21] Appl. No.: 634,852

[52] U.S. Cl. ..... 222/211; 222/481; 239/327

[51] Int. Cl.[2] ..... B05B 11/04

[58] Field of Search ..... 222/211, 209, 4, 206, 222/481; 239/327

[56] References Cited

UNITED STATES PATENTS

| | | | |
|---|---|---|---|
| 1,716,525 | 6/1929 | Leong | 239/327 |
| 2,098,160 | 11/1937 | Perritt | 222/209 |
| 2,673,123 | 3/1954 | Benoit et al. | 239/327 X |
| 3,622,049 | 11/1971 | Thompson | 239/327 X |

FOREIGN PATENTS OR APPLICATIONS

| | | | |
|---|---|---|---|
| 986,939 | 4/1951 | France | 222/211 |

*Primary Examiner*—Robert B. Reeves
*Assistant Examiner*—Frederick R. Handren
*Attorney, Agent, or Firm*—Richard L. Miller

[57] ABSTRACT

A bottle and cap of relatively very simple design for spraying an atomized liquid; the bottle being made of squeezable material so that air and liquid within its interior can be together forcibly pushed outwardly therefrom through a common port leading from an air-liquid mixing chamber in the cap, the air being originally admitted into the bottle through a one-way valve which automatically closes when the bottle is squeezed.

1 Claim, 5 Drawing Figures

AIR ATOMIZER BOTTLE SPRAYER WITH SCREW CAP

This invention relates generally to atomizer containers.

A principal object of the present invention is to provide an atomizer bottle that permits a fine aerosol dispensing of products such as hairsprays, lotions, household products, garden sprays, cosmetics and the like without the use of dangerous harmful propellant gasses.

Another object is to provide an atomizer bottle who's elementary construction eliminates plugging and mechanical failure that is common to plunger-spring type sprayers.

Yet another object is to provide an atomizer bottle which is safe as it cannot explode if subjected to heat or incineration.

Other objects are to provide an air atomizer bottle sprayer which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
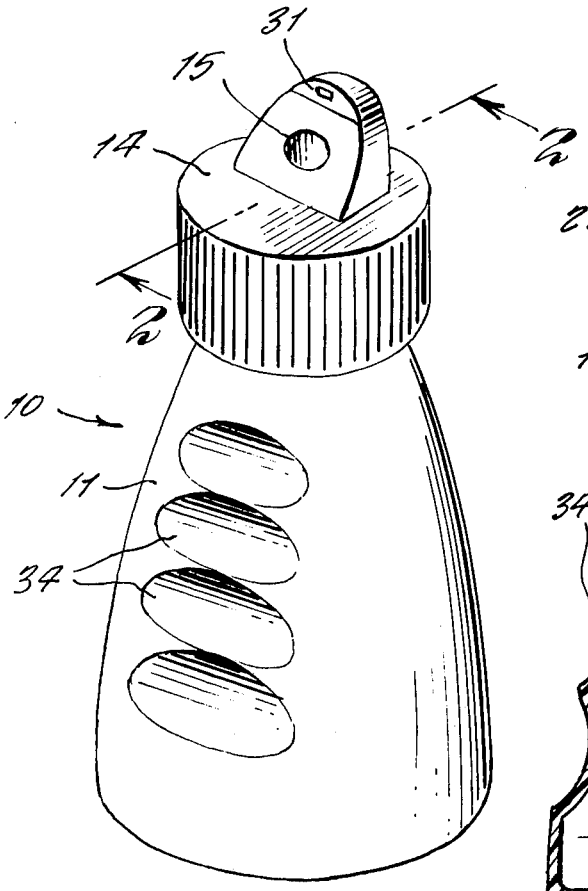
FIG. 1 is a perspective view of the invention.
Figure 2:
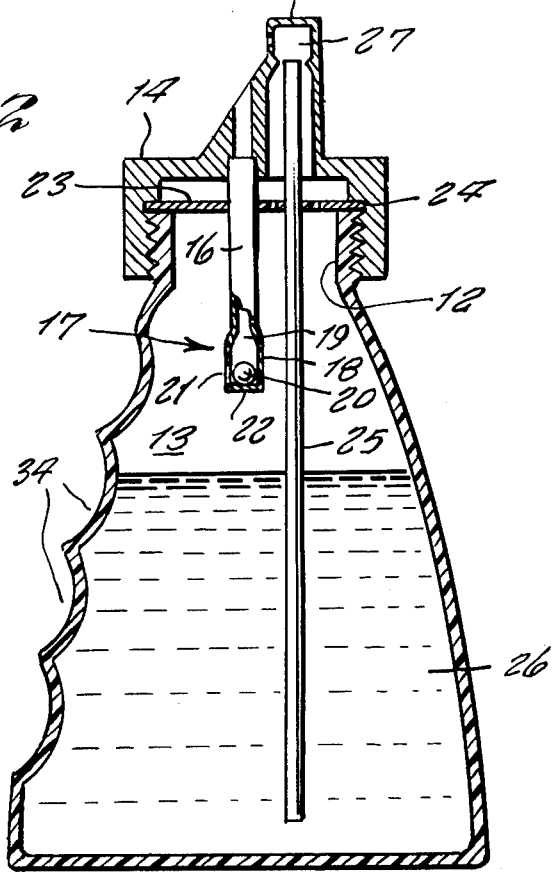
FIG. 2 is a cross sectional view taken on line 2-2 of FIG. 1.
Figure 3:
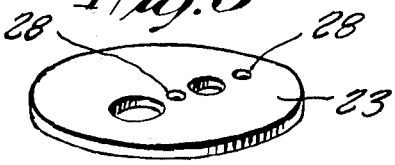
FIG. 3 is a perspective view of a holding disc forming a component of the invention.

Referring now to the drawing in greater detail, the reference numeral 10 represents an atomizer bottle according to the present invention wherein there is a squeezable, plastic bottle 11 having an opening through a neck 12 at its upper end, so that an interior 13 of the bottle communicates with a cap 14 that screw threads upon the neck.

The cap 14, made of hard plastic, includes an air intake passage 15 fitted with a downwardly extending valve tube 16 having a valve 17 at its lower end consisting of a diametrically enlarged chamber 18 having a concial valve seat 19 thereabove for seating a spherical stainless steel ball 20 and a small opening 21 on the side wall of the chamber 18 so that normally the ball resting on a lower end wall 22 of the chamber, permits exterior air to enter the bottle interior.

A circular holding disc 23 is secured in a bottom groove 24 of the cap, the disc frictionally holding a product dispensing long tube 25, the lower end of which is submerged in the liquid product 26 and the upper end of which extends into a mixing chamber 27 formed within an upper end of the cap. Small perforated openings 28 through the disc allow air to bleed from the bottle interior and into a passage 29 around upper portion of the tube 25 from where the air is obliged to pass through a constricting venture 30 located at the terminal end of the tube 25 and the mixing chamber 27. A small dispensing port 31 communicates the mixing chamber with the outside atmosphere.

Figure 4:
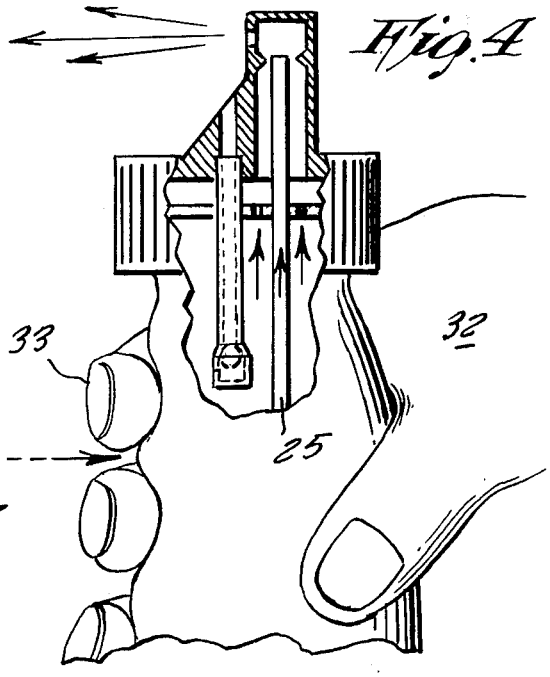
FIG. 4 is a view similar to FIG. 2 and showing the bottle being squeezed so to dispense an atomized spray.
Figure 5:
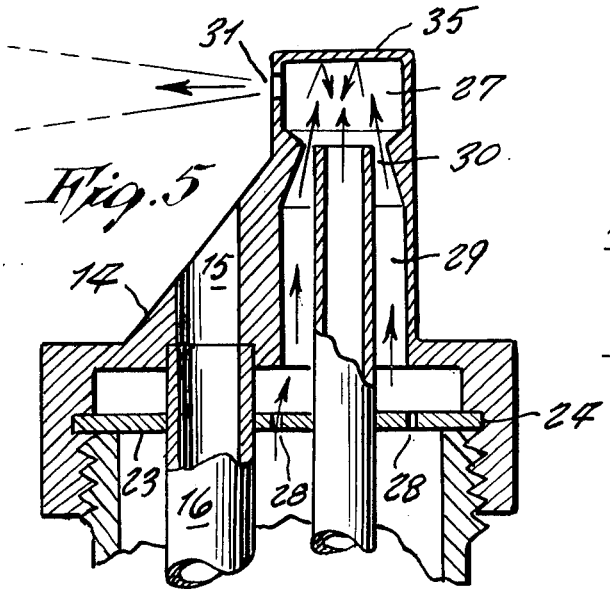
FIG. 5 is an enlarged detail of FIG. 4.

In operative use, to dispense the liquid product 26 in the form of an atomized spray, the bottle 11 is squeezed in a hand 32 as shown in FIG. 4, by the fingers 33 being comfortably fitted in finger grooves 34. Squeezing the bottle thus quickly builds up air pressure in the interior 13 thus causing the valve ball 20 to be lifted against the valve seat in the bottle then forces the liquid up the tube into the mixing chamber. At the same time the pressure forces air within the interior through openings 28 into the passage 29 and through the venturi 30. The speed of the air through the venturi is increased, this moving air all around the top opening of the tube 25 thus mixing with the product as both rebound against the top wall 35 of the mixing chamber so to result in a thorough mixing which then finds its way out of the dispensing opening 31 as a fine spray.

It is to be noted in the design of the present invention, that the valve tube 16 extends vertically downward and a lower portion thereof is contained within the interior 13 where it is subject to occasional submersion in the liquid 26, which is essential in order to prevent the ball 20 of the valve from sticking. Such occasional submersion prevents a thickening or gumming of the liquid in the valve. The vertical valve tube with the opening 21 at a lower end allows run-off of the liquid therefrom.

Upon releasing the pressure on the bottle, the steel ball 20 drops off the valve seat, allowing air to enter through air intake passage 15 into the bottle interior 13, thus replacing the volume of liquid and air dispensed from the opening 31.

Thus a simple and practical bottle sprayer is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit and scope of the invention.

What is claimed is:

1. An air atomizer bottle sprayer, comprising in combination a squeezable bottle having an opening through a neck at its upper end, and a hard plastic cap screw-threaded on said neck, said bottle having an interior containing liquid and a quantity of air above said liquid, said cap incorporating means for air from an atmosphere to freely enter said bottle interior when said bottle is relaxed from being squeezed, said means comprising an air intake opening fitted with a vertical valve tube having a lower portion thereof extending substantially downward into said interior, a one way valve at a lower end of said valve tube comprising a diametrically enlarged chamber containing a spherical ball vertically movable between a bottom end wall and a valve seat formed by a shoulder at an upper end of said diametrically enlarged chamber, and a side opening adjacent said bottom end, said one way valve automatically closing when said bottle is squeezed preventing an air passage therethrough from said bottle interior to said atmosphere; and a means to mix said liquid and said air from said interior and dispense the same atomized as a spray, wherein said means for mixing said air and liquid and dispensing thereof comprises a holding disc secured in a bottom of said cap, said holding disc frictionally supporting therethrough a dispensing tube having a lower end in said liquid and an upper end adjacent a mixing chamber thereabove, air bleed openings through said disc, an air passage between said disc and said mixing chamber, an air venturi adjacent said upper end of said tube, and a dispensing opening between said mixing chamber and said atmosphere.

* * * * *